US006561862B1

(12) United States Patent
Moore

(10) Patent No.: US 6,561,862 B1
(45) Date of Patent: May 13, 2003

(54) SWIM FIN ASSEMBLY

(76) Inventor: George B. Moore, 7121 Santa Fe Ave., Dallas, TX (US) 75223

( * ) Notice: Subject to any disclaimer, the term of this patent is extended or adjusted under 35 U.S.C. 154(b) by 0 days.

(21) Appl. No.: 10/098,893

(22) Filed: Mar. 15, 2002

(51) Int. Cl.[7] ..... A63B 31/11

(52) U.S. Cl. ..... 441/61; 441/64; 440/14; 440/25; 440/32

(58) Field of Search ..... 441/60–64; 440/25, 440/32, 14

(56) References Cited

U.S. PATENT DOCUMENTS

| | | | | | |
|---|---|---|---|---|---|
| 3,529,565 | A | * | 9/1970 | Iglesias | 441/55 |
| 3,934,290 | A | | 1/1976 | Le Vasseur | |
| 3,987,509 | A | | 10/1976 | Patterman | 9/309 |
| 4,193,371 | A | * | 3/1980 | Baulard-Caugan | 440/15 |
| 4,781,637 | A | | 11/1988 | Caires | 441/61 |
| 5,348,503 | A | | 9/1994 | Fechtner | 441/56 |
| 5,533,918 | A | | 7/1996 | Sanders | 444/64 |
| 6,086,440 | A | | 7/2000 | Fechtner | 441/64 |
| D430,637 | S | | 9/2000 | Evans | D21/806 |
| 6,375,530 | B1 | * | 4/2002 | Earl | 441/55 |

* cited by examiner

*Primary Examiner*—Jesus D. Sotelo
(74) *Attorney, Agent, or Firm*—Holland & Knight LLP

(57) ABSTRACT

A swim fin assembly of a generally T-shaped configuration including a flexible fin and an elongated foot support bar traversing and being operatively connected to the fin in a rigid securement. The fin is progressively more flexible from its forward end to its rearward end and from its upper and lower edges toward its center. A pair of foot receiving members are pivotally mounted on the foot support bar proximate its extended ends such that upon securing one's feet in the foot receiving members the fin is substantially perpendicular with respect to the wearer's feet such that upon exerting a stepping-type motion employing alternating thrusts in a prone position in a body of water, the resulting reciprocal pivotal movement of the foot support bar about its midpoint causes the vertically oriented fin to move from side-to-side and propel the wearer through the water.

34 Claims, 7 Drawing Sheets

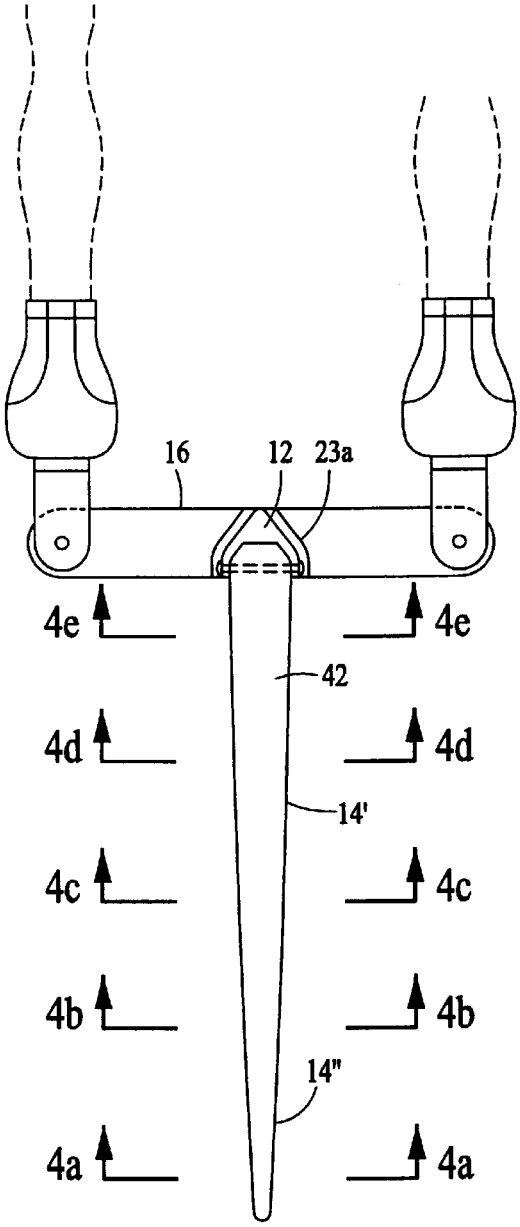
FIG. 3
FIG. 4a
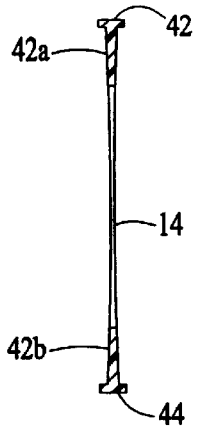
FIG. 4b
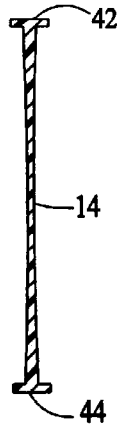
FIG. 4c
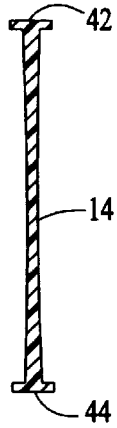
FIG. 4d
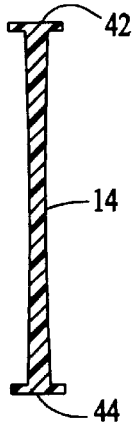
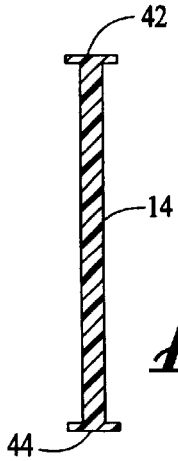
FIG. 4e

SWIM FIN ASSEMBLY

BACKGROUND OF THE INVENTION

The present invention relates to swim fins, and more particularly to a swim fin assembly in which a stepping type motion employing alternating leg thrusts is translated into a side-to-side movement of a vertically oriented fin to effect propulsion of the swimmer.

Swim fins are used by swimmers to increase the amount of water moved by the. wearer's feet to effect an increase in his or her speed without increasing their rate of kick. Swim fins have been designed for use with one of three types of kicking motion: the "scissors-kick"; the "dolphin-kick"; and the "shark-tail" kick. The scissors-kick method, which is the most common, requires the swimmer to move his or her legs back and forth in a scissors-like kicking motion to move through the water. The scissors-kick method is the foot and leg motion used in the conventional swimming stroke known as the "Australian Crawl." The swim fin used with the scissors-kick is generally of the conventional type in which the plane of each fin is essentially parallel to the plane of the soles of the feet and typically, the swimmer wears a separate fin on each foot. The scissors-kick is the most popular kicking stroke because it is simple to learn and somewhat intuitive. The dolphin-kick requires a swimmer to undulate his or her body to move both feet up and down at the same time, thus moving the fins up and down like the tail of a dolphin. Conventional fins can be used when swimming with a dolphin-kick although a line of extra wide fins called "monofins" into which both feet are inserted has been developed for use with a dolphin-kick. In the monofin, the fin is essentially parallel to the soles of the user's feet as in a conventional swim fin. The shark-tail method-differs from the dolphin-tail kick in that the swimmer's feet move in unison from side-to-side rather than up and down. This is a very unnatural swimming stroke for humans as the swimmer must undulate his or her body using their waist muscles to move both their feet from side-to-side, like the tail fin of a fish or shark. An example of a paddle and swim fin combination adapted for use with such a stroke is found in U.S. Pat. No. 5,348,503.

Conventional swim fins used with the scissors-kick require the swimmer to move their legs back and forth in a scissors-like motion to cause the fins to move up and down. While such fins are very popular, a scissor-kick movement utilizes relatively weak leg muscles and tends to strain the swimmer's ankles. Those novel swim fin arrangements that require swimmers to put both feet into a single fin and undulate their body to move the fin up and down (like a dolphin) or side-to-side (like shark), are less efficient, less powerful and more tiring than the scissors-kick employing standard swim fins. Thus, swim fins particularly adapted for such kicking motions have not proved to be commercially successful. It would be desirable if a swim fin assembly could be provided that allowed swimmers to use their stronger leg muscles to apply a greater force against the water than is applied with any of the above described devices, including conventional swim fins. Such a swim fin assembly would allow the swimmer to move significantly faster, more efficiently and more comfortably. It would also allow scuba divers to move more effortlessly through the water and thereby increase their dive time. Such a device is provided by the present invention.

SUMMARY OF THE INVENTION

Briefly, the present invention comprises a swim fin assembly of a generally T-shaped configuration including a flexible fin defining the leg of the T and an elongated foot support bar traversing and being operatively connected to the fin in a rigid securement so as to define the bar of the T. A pair of foot receiving members are pivotally mounted on the foot support bar proximate the extended ends of the bar such that upon securing one's feet in the foot receiving members the fin is disposed in a substantially perpendicular orientation with respect to the wearer's feet such that upon exerting a stepping-type motion employing alternating leg thrusts in a prone position in a body of water, the resulting reciprocal pivotal movement of the foot support bar about its midpoint causes the vertically oriented fin to move from side-to-side and propel the wearer through the water.

To enhance the effectiveness of the fin in the movement of water and thus the efficiency of the swim fin assembly, the fin is more rigid at its forward end proximate the rigid support member and increases in flexibility toward its rearward end. The fin also is more rigid adjacent its upper and lower edges and increases in flexibility towards the center of the fin between said edges. So configured, the moving fin channels water from front to rear and from the upper and lower edges towards a central portion of the fin, reducing spillover about the upper and lower edges thereof so as to increase the contact time of the moving water with the fin and thereby enhance the effectiveness of the movement of the fin and the performance provided thereby.

It is the principle object of the present invention to provide an improved swim fin assembly for propelling a swimmer through the water.

It is another object of the present invention to provide a swim fin assembly which allows swimmers to use their stronger leg muscles to apply greater force against the water than is applied with conventional swim fins.

It is a further object of the present invention to provide an improved swim fin assembly in which the swimmer can move faster, more efficiently and with less strain on their ankles than with conventional swim fins.

It is yet another object of the present invention to provide a swim fin assembly in which the fin is configured to effectively channel water from front to rear with minimal spillover at the top and bottom to maximize water contact time with the fin during use.

It is a still further object of the present invention to provide a swim fin assembly which is of simple construction and economical to manufacture.

These and other objects and advantages of the present invention will become readily apparent from the following detailed description taken in conjunction with the accompanying drawings.

BRIEF DESCRIPTION OF THE DRAWINGS

FIG. 3 is a plan view of the swim fin assembly of the present invention with the user's lower legs being shown in phantom lines.

FIGS. 4*a*–4*e* are sectional views taken along the lines 4*a*—4*a* through 4*e*—4*e* of FIG. 3.

DETAILED DESCRIPTION OF THE PRESENT INVENTION

Figure 1:
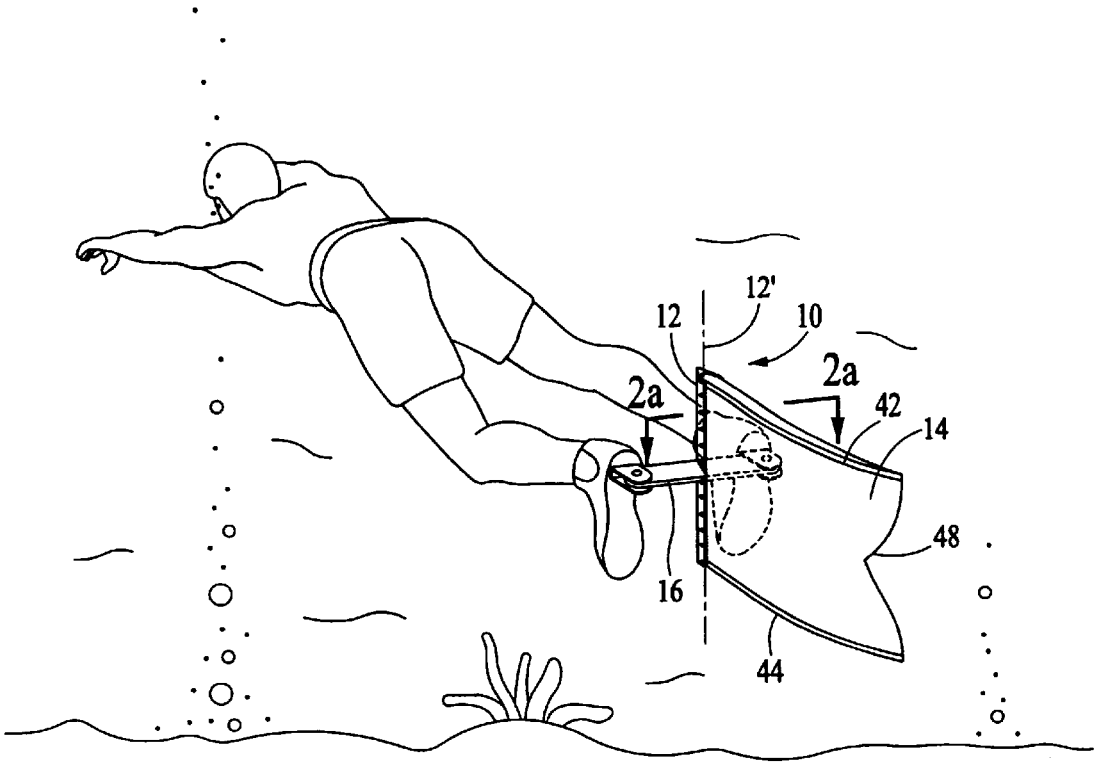
FIG. 1 is a perspective view of the swim fin assembly of the present invention illustrating the use thereof.

Referring now in detail to the drawings, the swim fin assembly 10 of the present invention comprises an elongated rigid fin support member 12, a flexible fin 14, a rigid foot support bar 16 and a pair of foot retaining members 18. The fin support member 12 is preferably constructed of a durable, lightweight and corrosion-resistant plastic or nylon material and defines a channel 20 open at its rearward end and extending parallel to the longitudinal axis 12' of the support member 12. The forward end portion 14' of fin 14 is disposed within channel 20 and a plurality of suitable fastening members 22 project through the bifurcated rear portion of support member 12 and the forward end portion 14' of fin 14 to securely attach the fin to the fin support member 12 such that the fin extends rearwardly from the support member parallel to the longitudinal axis 12' thereof. It is to be understood that other fastening techniques could be employed to secure the fin 14 to support member 12.

Figure 2A:
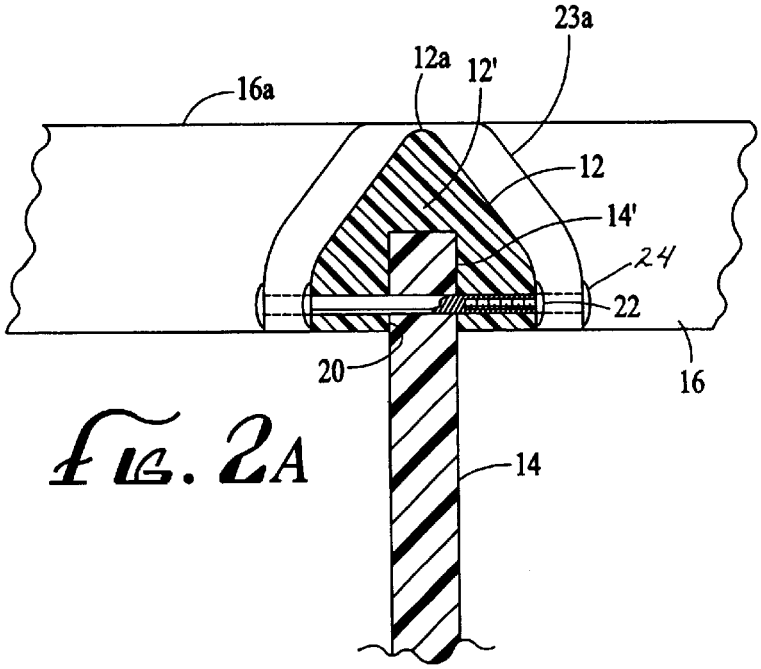
FIG. 2A is a partial sectional view of the swim fin assembly of the present invention taken along line 2A—2A in FIG. 1.
Figure 2B:
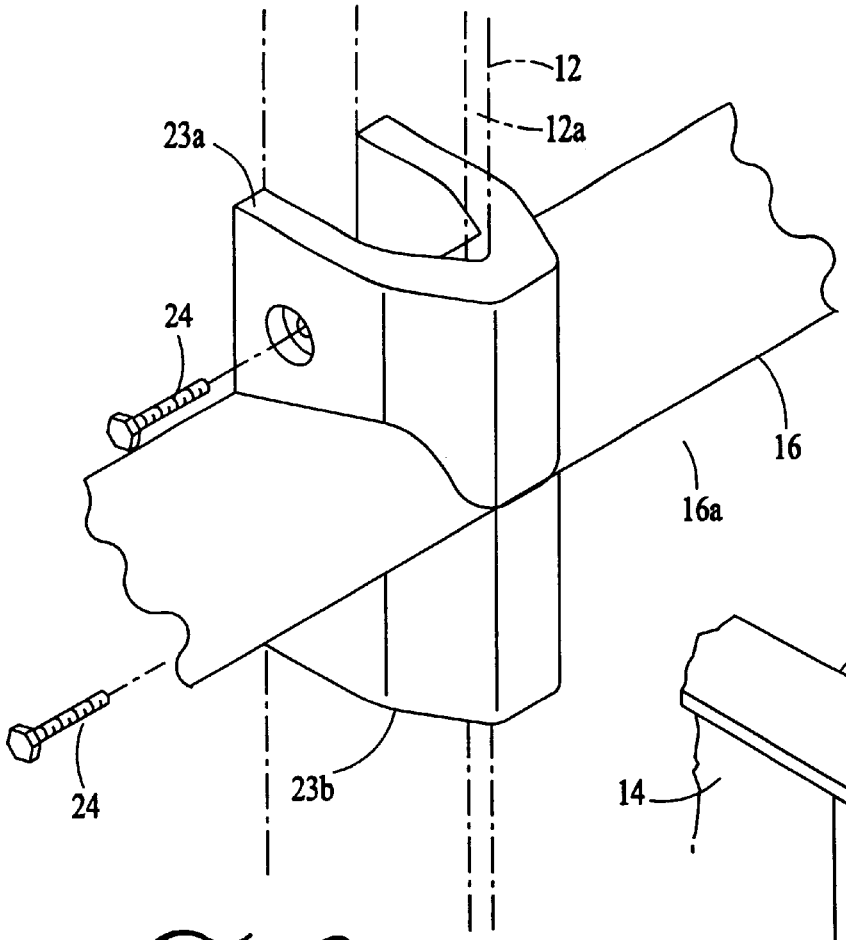
FIG. 2B is a partial perspective view illustrating the securement of the fin support member to the foot support bar with the fin support member being shown in phantom lines.
Figure 2C:
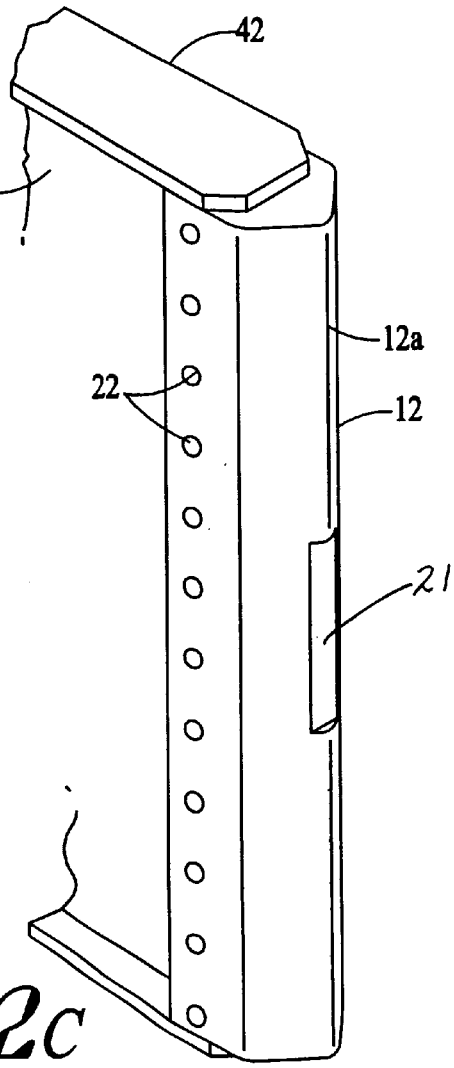
FIG. 2C is a partial perspective view illustrating the fin support member and fin.

The foot support bar 16 is carried by the support member 12 and is secured thereto intermediary of its extended ends by means of a pair of U-shaped brackets 23*a* and 23*b* projecting in opposed directions from the upper and lower surfaces 16*b* and 16*c* of the foot support bar 16. A pair of suitable fastening members 24 project through the leg portions of brackets 23*a* and 23*b* and support member 12 as illustrated in FIG. 2B. So secured, the foot support bar 16 is perpendicularly disposed with respect to the longitudinal axis 12' of support member 12 and the plane of the rearwardly projecting fin 14. Brackets 23*a* and 23*b* are preferably integrally formed with bar 16 and, as seen in FIG. 2C, a flat area 21 can be provided on the forward facing surface 12*a* of the fin support member 12 to mate with correspondingly configured surfaces (not shown) on the interiors of brackets 23*a* and 23*b* to assist in the proper positioning of the foot support bar 16 relative to the fin support member 12. Through such a securement, the foot support bar 16 can be separated from the fin support member 12 and fin 14 for storage and travel. Alternatively, the foot support bar 16 could be integrally formed with the support member 12 by injection molding or other suitable forming process. Through either type of construction, a generally T-shaped swim fin assembly configuration is provided in which the foot support bar 16 defines the bar of the T and the fin 14 and support member 12 define the leg of the T. Other means of securing the fin support member 12 and fin 14 to the foot support bar 16 to define the "T"-shaped configuration also could be employed. To reduce the drag on the assembly 10 during use, the forwardly facing surfaces 12*a* and 16*a* of the support member 12 and foot support bar 16 are preferably rounded and the upper and lower surfaces 16*b* and 16*c* of the foot support bar are tapered from front to rear as seen in FIG. 3.

Figure 8:
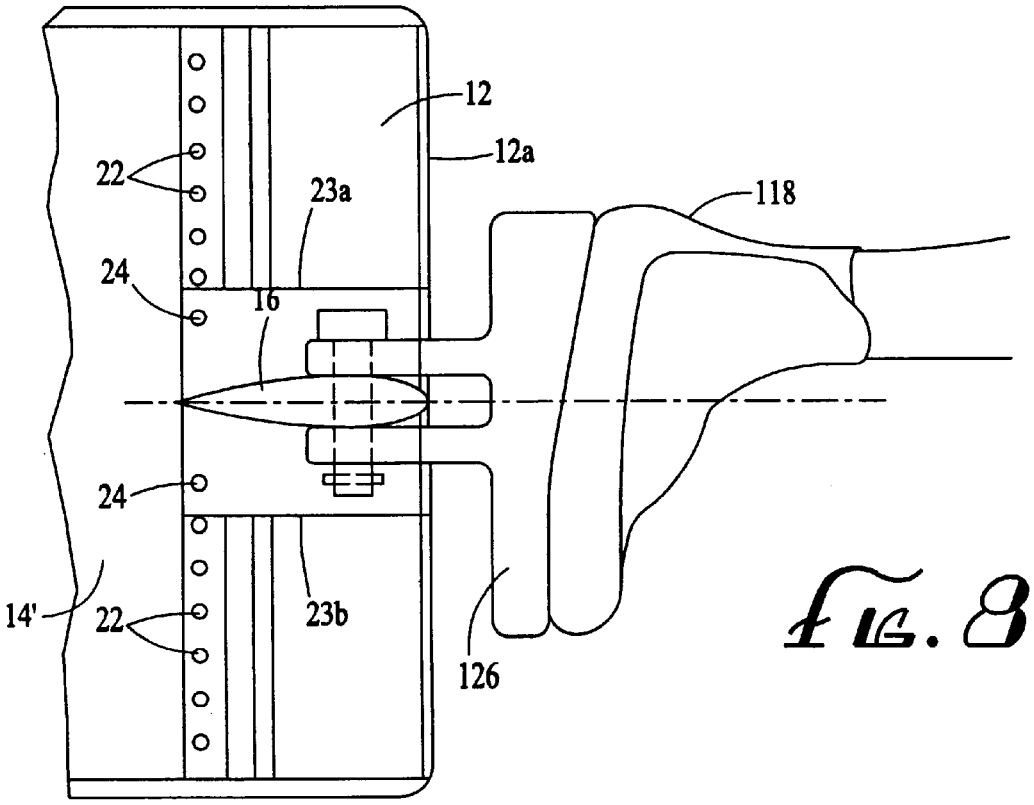
FIG. 8 is a partial side view of a modified embodiment of the present invention.

The foot retaining members 18 are preferably configured in a shoe or boot configuration, made of a soft rubber or other suitable material and provided with an open toe area 25 for foot size flexibility, a rigid sole plate formed of a nylon or plastic material and a Velcro closure 27. Sandal-like configurations having foot securement straps could also be employed. In the embodiment of the invention illustrated in FIGS. 1–5, the sole plate 26 of the boot-shaped foot retaining members 18 is disposed solely under the heel portion of the foot retaining members 18. In the embodiment of the invention shown in FIG. 8, the sole plate 126 extends the entire length of the underside of the foot-retaining member 118. The configuration of sole plate 26 in foot retaining member 18 is preferred as it forces the swimmer to swim using their hip and buttock muscles rather than just their quadriceps and hamstrings. Locating the sole plate under the heel puts the pressure on the user's heel, not the arch, eliminating the need for an arch support within the foot-retaining member.

Figure 7:
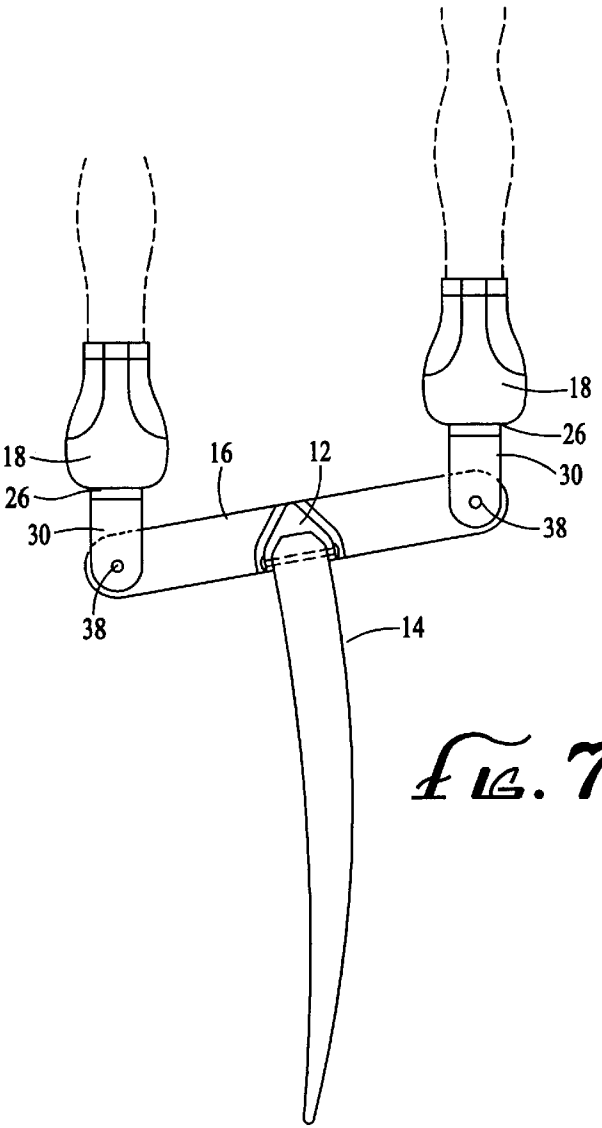
FIGS. 6 and 7 are schematic representations illustrating the movement of the fin in response to a stepping-type motion by the user.
Figure 6:
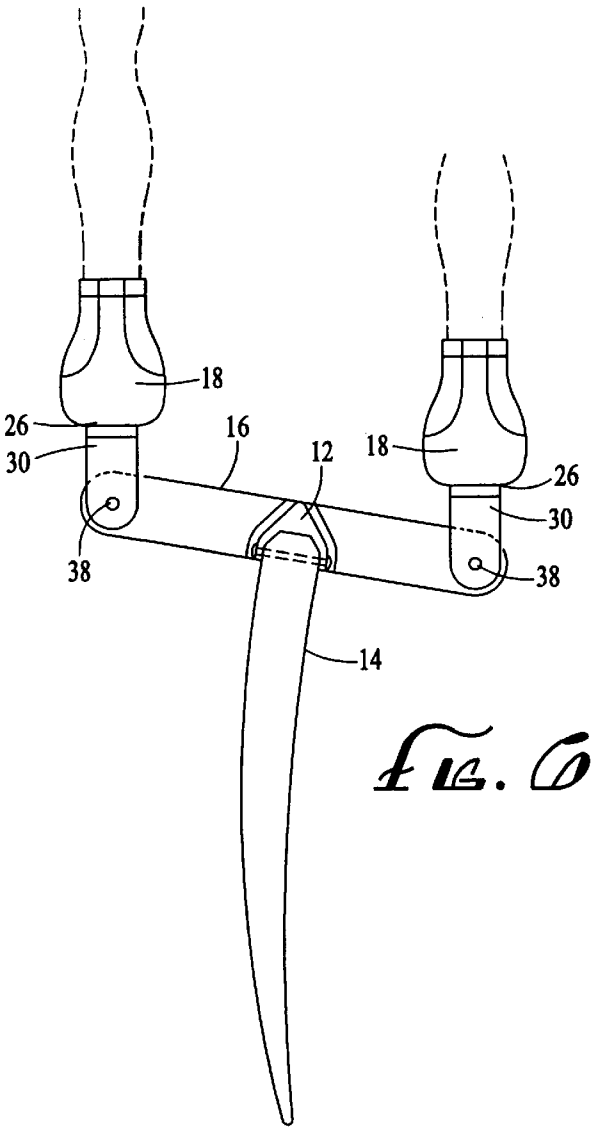

A pivot mount 30 is provided between the sole plate 26 of each foot retaining member 18 and the foot support bar 16 to secure the foot retaining members to bar 16 proximate its extended ends and enable the user to exert a stepping-type motion employing alternating leg thrusts so as to effect a reciprocal pivotal movement of the bar about its midpoint and thus cause the fin 14 to move from side-to-side as illustrated in FIGS. 6 and 7 and propel the user through the water. By providing a pivot mount between the foot retaining members 18 and the foot support bar 16, the fin 14 and support bar 16 can be moved side-to-side while the user's feet and the soles of the foot retaining members are maintained in a perpendicular disposition with respect to the direction of travel. The pivot members, however, are preferably configured so as to only allow lateral pivoting movement of the foot support bar relative to the foot retaining members to assist the user in controlling the device and prevent the fin 14 from moving upwardly or downwardly in the vertical plane.

The fin 14 preferably employed in the present invention is generally rectangular in configuration (although other shapes could be employed, e.g. fish tail) and is molded of a rubberized material such as neoprene or of a suitable plastic or nylon material so as to be light in weight, and corrosion resistant and progressively flexible in that the fin 14 is more rigid at its forward end 14' and increases in flexibility toward its rearward end 14". It also is more rigid adjacent its upper and lower edges and increases in flexibility toward the center portion of the fin intermediary of the upper and lower edges. To provide the desired changes in flexibility, the upper and lower edges of fin 14 are provided with reinforcing flanges 42 and 44 respectively. Flanges 42 and 44 can be of an I-beam configuration and diminish in thickness from the forward end 14' of the fin to the rearward end 14" thereof (see FIGS. 3 and 4*a*–4*e*). Additionally, as seen in FIGS. 3 and 4*a*–4*e*, the body portion 46 of fin 14 diminishes in thickness from its forward end 14' to its rearward end 14" and from the upper and lower flanges 42 and 44 to the center portion of the fin at 14*c*. A V-shaped cut-out 48 is preferably provided in the tail end of fin 14 to further enhance the flexibility of the central rearward area of the fin. As a result of such variations in thickness, the desired progressive flexibility is provided so that the moving fin will increasingly flex during use from front to rear and edge to center so as to move water from front to rear and from top and bottom toward the central portion of the fin, reducing spillover about the upper and lower edges thereof and increasing the contact time of the moving water with the fin. As a result, the effectiveness of the movement of the fin and the performance provided thereby are significantly enhanced. While other means of providing this desired variable flexibility in fin 14 could be employed such as variations in materials or composition from the front of the fin to the rear and the sides to the center or the use of laminated sections, it is believed that the above described variations in thickness would be the most economical.

Figure 5:
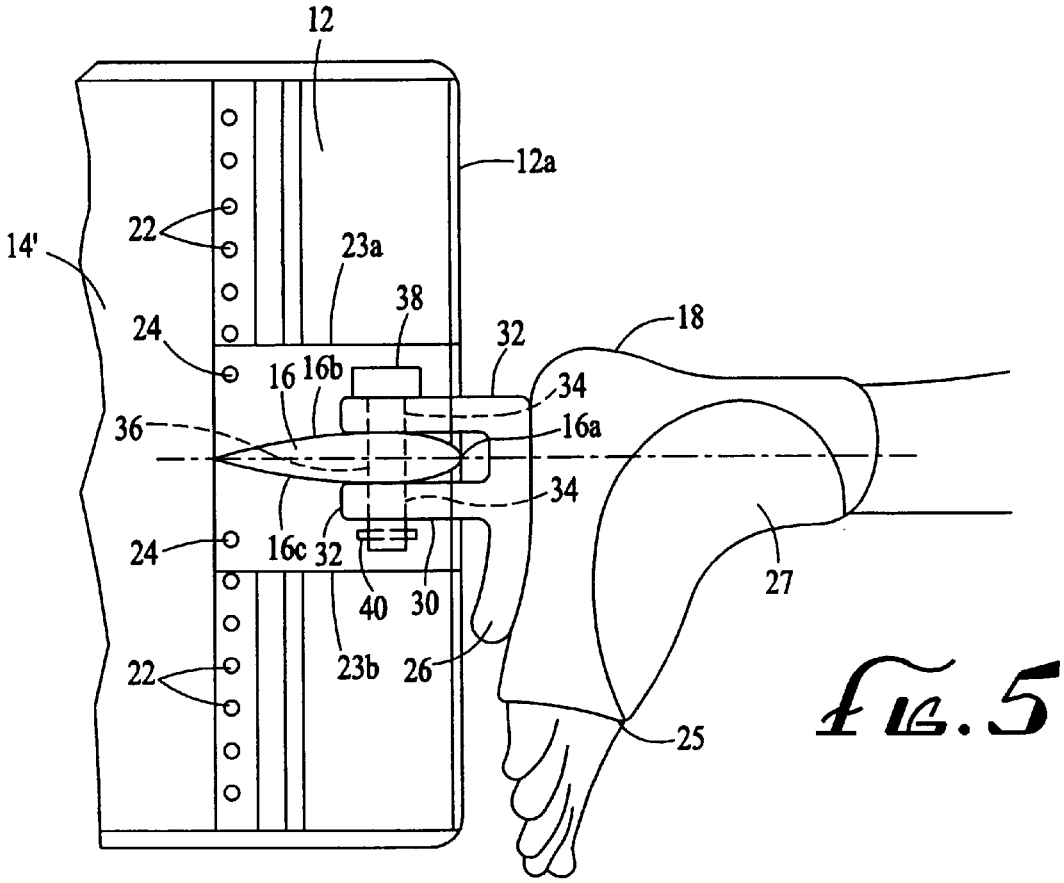
FIG. 5 is a partial side of the swim fin assembly of the present invention.

The embodiment of the pivot mounts 30 shown in FIG. 5 comprise a pair of axially spaced leg members 32 projecting perpendicularly from and preferably integrally formed with the sole plate 26 of the foot retaining members 18. The leg members 32 are positioned under the heel portion of the foot retaining members, are provided with aligned apertures 34 and extend about portions of the foot support bar 16 adjacent the ends thereof with apertures 34 in each pivot mount being aligned with an aperture 36 in the foot support bar. A nylon or plastic swivel pin 38 extends through aligned apertures 34 and 36 in each pivot mount and a locking pin 40 is provided to effect the pivotal securement of the foot retaining members to the support bar 16. Numerous other forms of pivotal mounts could also be employed.

Figure 11:
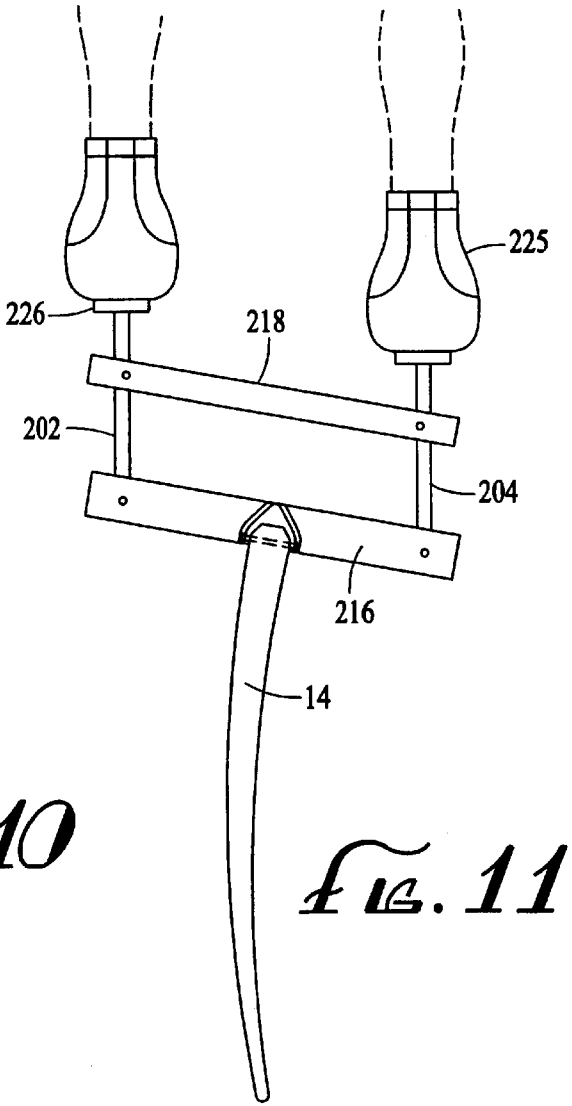
FIGS. 10 and 11 are schematic representations illustrating the movement of the fin in the alternate embodiment of the present invention in response to a stepping-type motion by the user.
Figure 10:
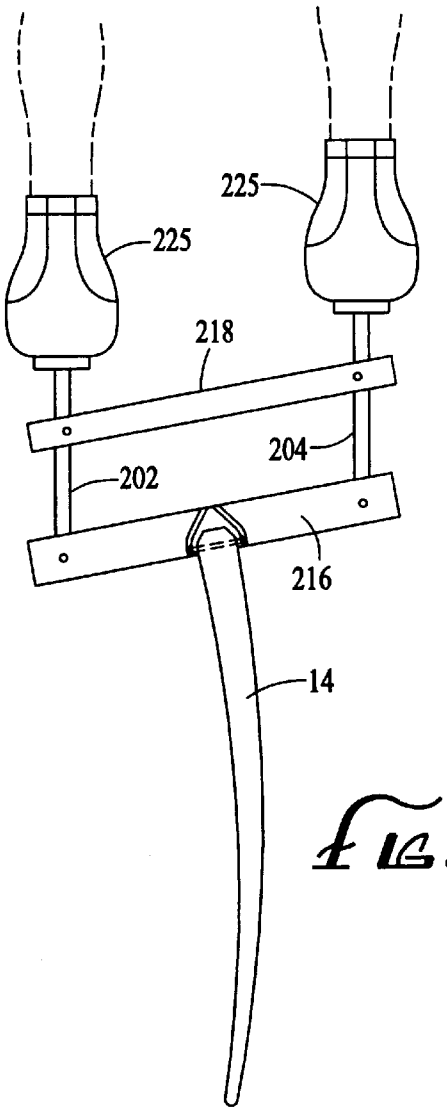
Figure 9:
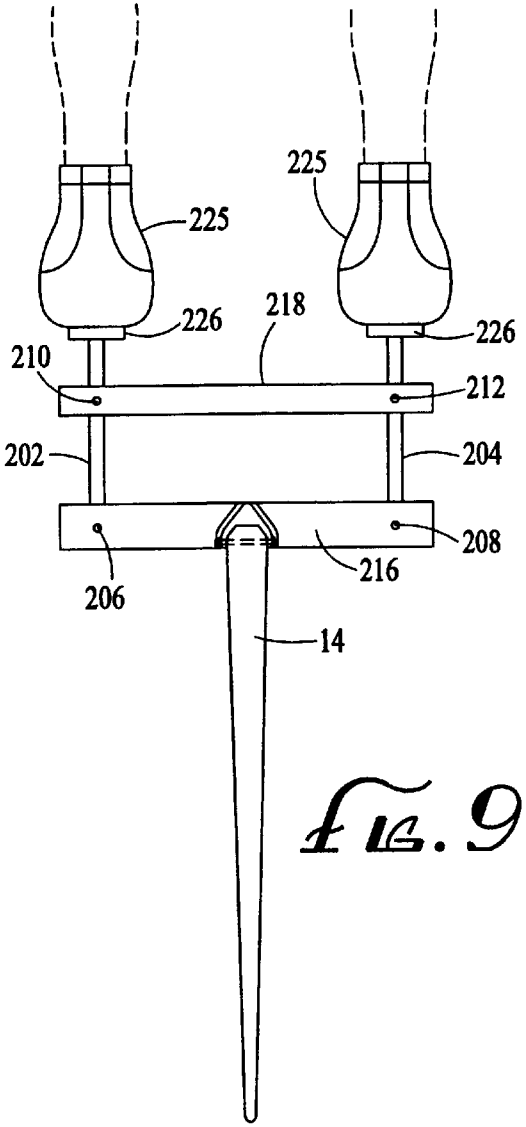
FIG. 9 is a top plan view of an alternate embodiment of the present invention.

In an alternate embodiment of the present invention shown in FIG. 9, a pair of extension rods 202 and 204 are pivotally connected to the extended ends of the foot support bar 216 by pins 206 and 208 and to the extended ends of a second rigid foot support bar 218 by pins 210 and 212. Rods 202 and 204 project forwardly from the supplemental foot extension bar 218 and are rigidly affixed at their extended ends to the sole plates 226 of the foot retaining members 225 as seen in FIG. 9. Bar 218, rods 202 and 204 and pivot pins 206–212 are again preferably formed of a durable lightweight and corrosion-resistant plastic or nylon material. As seen in FIGS. 10 and 11, when the user of the swim fin assembly 210 exerts a stepping-type motion employing alternating leg thrusts, the movement of the legs and feet in an alternating reciprocal motion will again effect repetitive side-to-side motion of the fin as in the prior embodiment of the present invention. It is to be understood that other mountings could also be employed between the foot retaining members and the support bar to translate the alternating leg thrusts employed in a stepping-type motion into the side-to-side movement of fin 14.

Figure 12:
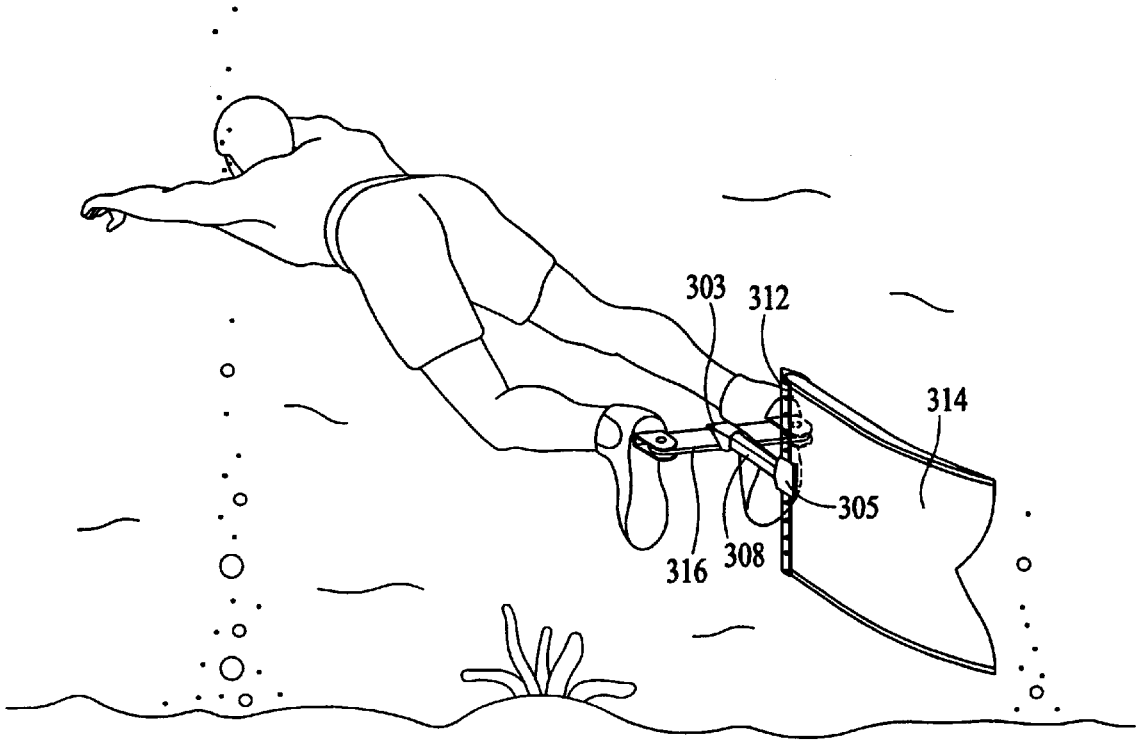
FIG. 12 is a perspective view of another embodiment of the present invention illustrating the use thereof.

In another embodiment of the present invention illustrated in FIG. 12, a fin extension 308 is provided between the fin support member 312 and foot support bar 316. This alternate embodiment allows for the axial distance between the fin and the foot support bar to be selectively varied for different users, the stronger the user, the longer the extension 308. Thus, the extension 308 is preferably removeable for replacement with an extension 308 of a different length. The extension 308 could be provided with U-shaped clamps 303 and 305 at its forward and rearward ends (rotated 90° with respect to one another) for securement to the fin support member 312 and foot support bar 316 and thus form the operative connection between the fin and the foot support bar. The extension 308, preferably increases in flexibility from front to rear. This could be achieved with a tapered fiberglass rod similar to a section of a fishing pole.

Figure 13:
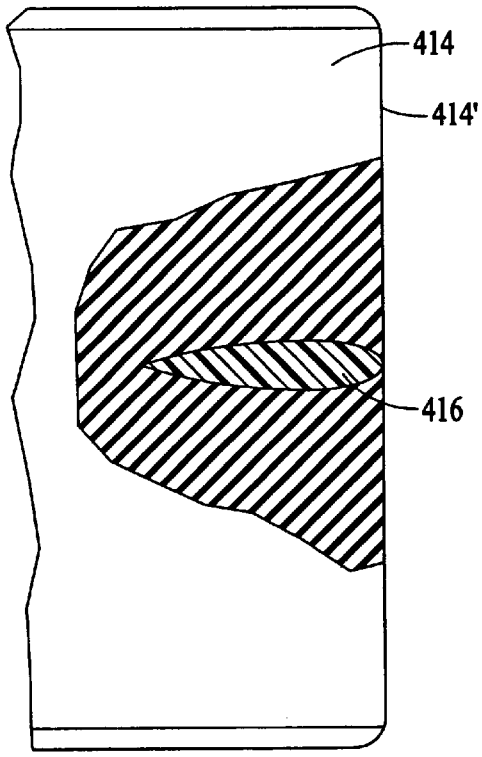
FIG. 13 is a partial sectional view of yet another embodiment of the present invention.

In another embodiment of the present invention (see FIG. 13) wherein the fin 414 is formed of a neoprene material, the forward end 414' thereof could be molded directly about the foot support bar 416 to effect securement of the fin to the bar without the need for a fin support member 12. Alternatively, the forward end of the fin could be molded about a fin support member and the fin support member secured to the foot support bar as in the previously described embodiments. Other modifications could be made and attachments employed to form the generally T-shaped swim fin assembly of the present invention without departing from the spirit and scope thereof. Insofar as such changes and modifications are within the purview of the appended claims, they are to be considered as part of the present invention.

I claim:

1. A swim fin assembly adapted to be affixed to the feet of a swimmer for use in propelling the swimmer through a body of water, said assembly comprising an elongated fin support member defining a longitudinal axis extending therethrough, a generally planar fin carried by said fin support member and extending rearwardly therefrom in alignment with said axis, an elongated foot support bar carried by and traversing said fin support member and defining extended end portions on opposed sides of said fin support member and a pair of foot receiving members, one of said foot receiving members being pivotally mounted on each of said extended end portions of said foot support bar whereby upon the swimmer's feet being secured in said foot receiving members and the swimmer exerting a stepping-type motion employing alternating leg thrusts in a body of water, said fin is caused to move from side-to-side propelling the swimmer through the water.

2. The swim fin assembly of claim 1 wherein said foot receiving members each comprise a foot receiving area, a substantially rigid sole plate and a first pivot portion carried by said sole plate and including a second pivot portion carried by each of said extending end portions of said foot support bar, said second pivot portions being operatively connected to said first pivot portions to provide a pivotal mounting of said foot receiving members on said foot support member whereby each of said foot receiving members can pivot laterally on and with respect to said foot support bar.

3. The swim fin assembly of claim 2 wherein the sole plates on said foot receiving members are disposed perpendicular to said foot support bar and parallel to said longitudinal axis of said fin support member.

4. The swim fin assembly of claim 1 wherein said fin defines a forward end and a rearward end, said forward end being secured to said fin support member and wherein said fin is progressively more flexible from said forward end to said rearward end.

5. The swim fin assembly of claim 1 wherein said fin defines a forward end, a rearward end, an upper edge and a lower edge, said forward end being secured to said fin support member and wherein said fin is progressively more flexible from said forward end to said rearward end and from said upper and lower edges toward a central area disposed intermediary of said upper and lower edges.

6. The swim fin assembly of claim 5 including a substantially V-shaped cutout area formed in said rearward end of said fin and tapering inwardly toward said forward end thereof whereby the flexibility of a central portion of the rearward end of said fin is increased.

7. The swim fin assembly of claim 1 wherein said swim fin support member and said foot support bar are of a single piece construction and formed of a lightweight corrosive resistant plastic material.

8. The swim fin assembly of claim 1 wherein said swim fin support member and said foot support bar are of a single piece construction and formed of a lightweight corrosive resistant nylon material.

9. The swim fin assembly of claim 2 wherein said fin defines a forward end and a rearward end, said forward end being secured to said fin support member and wherein said fin is progressively more flexible from said forward end to said rearward end.

10. The swim fin assembly of claim 2 wherein said fin defines a forward end, a rearward end, an upper edge and a lower edge, said forward end being secured to said fin support member and wherein said fin is progressively more flexible from said forward end to said rearward end and from said upper and lower edges toward a central area disposed intermediary of said upper and lower edges.

11. The swim fin assembly of claim 10 wherein said fin is formed of a rubberized material.

12. The swim fin assembly of claim 10 including a first rib extending along said upper edge of said fin and a second rib extending along said lower edge of said fin, said first and second ribs progressively diminishing in size from said forward end of said fin to said rearward end thereof whereby the flexibility of said fin proximate said ribs increases from the forward end thereof to the rearward end thereof.

13. The swim fin assembly of claim 1 wherein said fin defines a forward end and a rearward end, an upper edge and a lower edge, said fin varying in thickness from said forward end to said rearward end and from said upper and lower edges toward a central area disposed intermediary thereof whereby said fin is progressively more flexible from said forward end to said rearward end and from said upper and lower edge portions toward said central area.

14. A swim fin assembly adapted to be affixed to the feet of a swimmer for use in propelling the swimmer through a body of water, said assembly comprising an elongated fin support member defining a longitudinal axis extending therethrough, a generally planar fin carried by said fin support member and extending rearwardly therefrom in alignment with said axis, an elongated foot support bar carried by and traversing said fin support member and defining extended end portions on opposed sides of said fin support member and a pair of foot receiving members, each of said foot receiving members including a flexible foot receiving area, a rigid sole plate and a first pivot portion projecting from said sole plate, and including a second pivot portion carried by each of said extended end portions of said foot support bar, said second pivot portions being operatively connected to said first pivot portions to provide a pivotal mounting of said foot receiving members on said foot support bar whereby upon the swimmer's feet being secured in said foot receiving members and the swimmer exerting a stepping-type motion employing alternating leg thrusts in a body of water, each of said foot receiving members can pivot laterally on and with respect to said foot support bar and said fin is caused to move from side-to-side to propel the swimmer through the water.

15. The swim fin assembly of claim 14 wherein the sole plates on said foot receiving members are disposed perpendicular to said foot support member and parallel to said longitudinal axis of said fin support member.

16. The swim fin assembly of claim 14 wherein said fin defines a forward end and a rearward end, said forward end being secured to said fin support member and wherein said fin is progressively more flexible from said forward end to said rearward end.

17. The swim fin assembly of claim 14 wherein said fin defines a forward end, a rearward end, an upper edge and a lower edge, said forward end being secured to said fin support member and wherein said fin is progressively more flexible from said forward end to said rearward end and from said upper and lower edges toward a central area disposed intermediary of said upper and lower edges.

18. The swim fin assembly of claim 17 including a substantially V-shaped cutout area formed in said rearward end of said fin and tapering inwardly toward said forward end thereof whereby the flexibility of a central portion of the rearward end of said fin is increased.

19. The swim fin assembly of claim 14 wherein said first pivot portion comprises a pair of spaced leg members projecting perpendicularly from said sole plate and defining aligned apertures therein, said second pivot portion comprises a channel extending through one of said extended end portions of said foot support bar in axial alignment with said apertures in said leg members and wherein said operative connection includes a locking pin extending through said aligned apertures and channel.

20. The swim fin assembly of claim 19 wherein said fin defines a forward end, a rearward end, an upper edge and a lower edge, said forward end being secured to said fin support member and wherein said fin is progressively more flexible from said forward end to said rearward end and from said upper and lower edges toward a central area disposed intermediary of said upper and lower edges.

21. The swim fin assembly of claim 20 including a substantially V-shaped cutout area formed in said rearward end of said fin and tapering inwardly toward said forward end thereof whereby the flexibility of a central portion of the rearward end of said fin is increased.

22. A generally T-shaped swim fin assembly adapted to be affixed to the feet of a swimmer for use in propelling the swimmer through a body of water, said assembly comprising a generally planar fin defining a forward end and a rearward end, an elongated foot support carried by and traversing said forward end of said fin and defining extended end portions on opposite sides of said fin and a pair of foot receiving members, one of said foot receiving members being pivotally mounted on each of said extended end portions of said foot support whereby upon the swimmer's feet being secured in said receiving members and the swimmer exerting a stepping-type motion employing alternating leg thrusts in a body of water, said fin is caused to move from side-to-side to propel the swimmer through the water.

23. The swim fin assembly of claim 22 wherein said foot receiving members each comprise a foot receiving area, a substantially rigid sole plate and a first pivot portion carried by said sole plate and including a second pivot portion carried by each of said extending end portions of said foot support member, said second pivot portions being operatively connected to said first pivot portions to provide a pivotal mounting of said foot receiving members on said foot support member whereby each of said foot support members can pivot laterally on and with respect to said foot support member.

24. The swim fin assembly of claim 22 wherein said fin defines a forward end and a rearward end, said fin being progressively more flexible from said forward end to said rearward end.

25. The swim fin assembly of claim 22 wherein said fin defines a forward end, a rearward end, an upper edge and a lower edge, and wherein said fin is progressively more flexible from said forward end to said rearward end and from said upper and lower edges toward a central area disposed intermediary of said upper and lower edges.

26. The swim fin assembly of claim 23 wherein said fin defines a forward end and a rearward end, said fin being progressively more flexible from said forward end to said rearward end.

27. The swim fin assembly of claim 23 wherein said fin defines a forward end, a rearward end, an upper edge and a lower edge, and wherein said fin is progressively more flexible from said forward end to said rearward end and from said upper and lower edges toward a central area disposed intermediary of said upper and lower edges.

28. The swim fin assembly of claim 25 including a first rib extending along said upper edge of said fin and a second rib extending along said lower edge of said fin, said first and second ribs progressively diminishing in size from said forward end of said fin to said rearward end thereof whereby the flexibility of said fin proximate said ribs increases from the forward end thereof to the rearward end thereof.

29. A swim fin assembly adapted to be affixed to the feet of a swimmer for use in propelling the swimmer through a body of water, said assembly comprising an elongated fin support member defining a longitudinal axis extending therethrough, a generally planar fin carried by said fin support member and extending rearwardly therefrom in alignment with said axis, an elongated foot support bar traversing said fin support member and defining extended end portions on opposed sides of said fin support member, an extension member extending between and being secured to said fin support member and said foot support bar for operatively connecting said fin to said foot support bar in a rigid securement and a pair of foot receiving members, one of said foot receiving members being pivotally mounted on each of said extended end portions of said foot support bar whereby upon the swimmer's feet being secured in said foot receiving members and the swimmer exerting a stepping-type motion employing alternating leg thrusts in a body of water, said fin is caused to move from side-to-side propelling the swimmer through the water.

30. The swim fin assembly of claim 29 wherein said extension member is progressively more flexible from said foot support bar to said fin support member.

31. A generally T-shaped swim fin assembly adapted to be affixed to the feet of a swimmer for use in propelling the swimmer through a body of water, said assembly comprising a generally planar fin defining a forward end and a rearward end, an elongated foot support traversing said forward end of said fin and defining extended end portions on opposite sides of said fin, an extension member extending between and operatively connecting said fin to said foot support in a rigid securement and a pair of foot receiving members, one of said foot receiving members being pivotally mounted on each of said extended end portions of said foot support whereby upon the swimmer's feet being secured in said receiving members and the swimmer exerting a stepping-type motion employing alternating leg thrusts in a body of water, said fin is caused to move from side-to-side to propel the swimmer through the water.

32. The swim fin assembly of claim 31 wherein said extension member is progressively more flexible from said foot support bar to said fin support member.

33. The swim fin assembly of claim 32 wherein the operative connection of said extension member to said fin and said foot support bar is releasable for removal and replacement of said extension member.

34. A method for propelling a swimmer through a body of water comprising the steps of: securing one's feet to extended end portions of a rigid support bar having a flexible fin extending perpendicularly from the midpoint of said bar such that the feet are disposed perpendicularly with respect to the fin and can pivot laterally relative to the bar; and exerting a stepping-type motion employing alternating leg thrusts whereby said bar is caused to reciprocally pivot about said midpoint and with respect to said feet and said fin is caused to move from side-to-side propelling the swimming through the water.

* * * * *